United States Patent [19]

Sigman et al.

[11] 4,360,110

[45] Nov. 23, 1982

[54] POSITIVE GRIP LIFTING MECHANISM

[75] Inventors: Earl H. Sigman; Timothy E. Abblett, both of Alliance, Ohio

[73] Assignee: AMCA International Corporation, Hanover, N.H.

[21] Appl. No.: 178,887

[22] Filed: Aug. 18, 1980

[51] Int. Cl.[3] ..... B66C 7/16; B66C 13/50

[52] U.S. Cl. ..... 212/159; 212/221; 294/67 BB; 294/106; 294/DIG. 2

[58] Field of Search ..... 294/67 BB, 67 BC, 81 R, 294/86 R, 113, DIG. 2, 106; 212/221, 132, 159

[56] References Cited

U.S. PATENT DOCUMENTS

| | | | |
|---|---|---|---|
| 1,807,360 | 5/1931 | Wehr | 294/DIG. 2 |
| 2,226,789 | 12/1940 | Tupy | 294/DIG. 2 |
| 2,718,320 | 9/1955 | Nelson et al. | 294/67 BB |
| 2,718,321 | 9/1955 | Westermeyer | 294/67 BB |
| 2,879,102 | 3/1959 | Kughler | 294/86 R |
| 3,002,779 | 10/1961 | Frate et al. | 294/86 R |
| 3,103,282 | 9/1963 | York | 212/221 |
| 3,111,228 | 11/1963 | Anderson | 212/221 |

FOREIGN PATENT DOCUMENTS

| | | | |
|---|---|---|---|
| 678887 | 1/1964 | Canada | 212/221 |
| 1531250 | 12/1969 | Fed. Rep. of Germany | 294/67 BC |
| 1575704 | 7/1969 | France | 212/221 |
| 54-17255 | 2/1979 | Japan | 294/86 R |

*Primary Examiner*—Johnny D. Cherry
*Assistant Examiner*—Michael J. Forman
*Attorney, Agent, or Firm*—Maky, Renner, Otto & Boisselle

[57] ABSTRACT

A tong 200 for use in lifting articles such as aluminum or steel ingots and the like comprising an elongated leg member 210, a pivot member 212 fixedly attached to and depending from leg 210, said pivot member having an upper portion and a lower portion 220, an upper link 214 pivotally attached to and projecting outwardly of said upper portion of said pivot member, a lower link 218 pivotally attached to and projecting outwardly of said lower portion of said pivot member, a tong bit 224 having an upper portion 225 disposed outwardly of said pivot member and a lower portion 261, said upper portion of said tong bit being pivotally attached to upper link 214, said lower portion of said tong bit being pivotally attached to lower link 218, said lower portion of said tong bit extending under said pivot member and having an innermost end 246 projecting inwardly of said pivot member, and means 230 for resiliently restraining said tong bit against pivot member 212. A grab assembly 16 and a crane 10 for employing said tong are also disclosed.

30 Claims, 8 Drawing Figures

POSITIVE GRIP LIFTING MECHANISM

TECHNICAL FIELD

This invention relates to cranes, and in particular to grab assemblies suspended by cranes for hoisting and moving massive articles such as aluminum or steel ingots. The invention further relates to positive grip lifting tongs that engage the sides of the articles being lifted.

BACKGROUND OF THE INVENTION

The handling of massive articles such as aluminum or steel ingots and the like either at the smelter, steel mill, or fabricating facilities presents a problem due to the relatively great mass and weight of these articles, as well as to the fact that their elongated shapes make them awkward to handle. Typical dimensions of such ingots are, for example, 2×3×7 feet, or larger. Ingots of aluminum of this size generally exceed about 5,000 pounds in weight, and ingots of steel of this size generally exceed about 12,000 pounds. Additionally, care must be taken not to damage the upper or lower surfaces of such ingots due to the fact that such damaged surfaces often result in sheet or plate products produced in subsequent milling operations with unacceptable indentations or holes in their upper or lower surfaces. On the other hand, it has been found that indentations on the sides of such articles are significantly less detracting to the quality of the milled products produced therefrom.

It will be understood that terms such as "upper" or "top", "lower" or "bottom", and "side" are used in the specification and claims with reference to the orientation of the article being lifted when such article is at rest at the ground or floor level with the long dimension of the article extending horizontally, and terms such as "inner" or "inwardly" and "outer" or "outwardly" herein designate directions respectively toward and away from the article being lifted.

Present day lifting mechanisms typically include inwardly extending legs or hooks for gripping the bottoms of the articles being lifted. Examples of such devices are disclosed, for example, in U.S. Pat. Nos. 2,695,809; 2,841,434; 2,959,411; 2,987,339; 3,076,673; 3,086,808 and 3,097,875. These devices have been found to cause indentations in the bottoms of the articles being lifted and, consequentially, are unacceptable for use in lifting articles, such as ingots and the like, which must undergo subsequent milling operations.

Lifting mechanisms for grabbing coil structures from their side have been proposed, but such mechanisms are inadequate for lifting massive articles such as ingots due to the size and power requirements of the motor and gear assemblies required to operate the clamping jaws of such devices. Examples of such coil lifters are disclosed, for example, in U.S. Pat. Nos. 2,945,608; 2,945,609 and 3,153,555.

U.S. Pat. No. 3,155,416 teaches the use of tongs with serrated edges for gripping the sides of the article being lifted, but does not teach the use of a positive gripping mechanism for engaging the side of the article being lifted.

SUMMARY OF THE INVENTION

Cranes that employ positive grip lifting tongs of the type hereinafter described can be used to hoist and move massive articles such as aluminum or steel ingots and the like without damaging the bottoms of such articles and with significantly less power requirements than used by prior art devices employing non-positive acting side clamping mechanisms. Broadly stated, the invention contemplates a tong for use in lifting articles, such as aluminum or steel ingots and the like, comprising: an enlongated leg; a pivot member fixedly attached to and depending from said leg, said pivot member having an upper portion and a lower portion; an upper link pivotally attached to and projecting outwardly of said upper portion of said pivot member; a lower link pivotally attached to and projecting outwardly of said lower portion of said pivot member; a tong bit having an upper portion disposed outwardly of said pivot member and a lower portion, said upper portion of said tong bit being pivotally attached to said upper link, said lower portion of said tong bit being pivotally attached to said lower link, said lower portion of said tong bit extending under said pivot member and having an innermost end projecting inwardly of said pivot member; and means for resiliently restraining said tong bit against said pivot member. In a preferred embodiment a jaw with a sufficiently smooth bevelled edge to minimize or eliminate indentations in the sides of the articles being lifted is formed on said innermost end. In a greatly preferred embodiment this jaw includes a tong key bit for penetratingly engaging the side of the article being lifted. Advantageously, an auxiliary jaw depends from the bottom of the lower portion of the tong bit. This auxiliary jaw preferably is disposed downwardly and outwardly of said innermost end.

Further, the present invention contemplates a grab assembly for lifting articles such as aluminum or steel ingots and the like, comprising: a support frame; a first pair of vertically projecting horizontally movable opposed complemental tongs depending from and extending beneath said frame; means for moving said first pair of tongs horizontally inward and outward; a second pair of vertically extending horizontally movable opposed complemental tongs depending from and extending beneath said frame member, said second pair of tongs being disposed in spaced parallel relationship to said first pair of tongs; means for moving said second pair of tongs horizontally inward and outward; each of said tongs including a vertically elongated leg, a pivot member fixedly attached to and depending from said leg, said pivot member having an upper and a lower portion, a tong bit having an upper and a lower portion, said upper portion of said tong bit being pivotally attached to the outside of said upper portion of said pivot member by an upper link member, said lower portion of said tong bit being pivotally attached to the lower portion of said pivot member by a lower link member and extending under said pivot member and having an innermost end projecting inwardly of said pivot member, and means for resiliently restraining said tong bit against said pivot member. In a preferred embodiment the grab assembly comprises a centrally disposed cylindrically shaped housing fixedly attached to and projecting above said frame and a lifting beam that can be either rotatably or fixedly mounted on said housing. In a particularly advantageous and, therefore, greatly preferred embodiment, the support frame comprises a pair of horizontally elongated parallel spaced frame members connected by a horizontally elongated frame member disposed perpendicularly to said parallel spaced frame members.

Further, the present invention contemplates a crane for transporting articles, such as aluminum or steel ingots and the like, comprising: a plurality of ropefalls depending from the bridge of said crane; a support frame suspended by said ropefalls; a first pair of vertically elongated horizontally movable opposed complemental tongs depending from and projecting below said support frame; means for moving said first pair of tongs inwardly and outwardly; a second pair of vertically elongated horizontally movable opposed complemental tongs depending from and projecting below said support frame, said second pair of tongs being disposed in spaced parallel relationship to said first pair of tongs; means for moving said second pair of tongs inwardly and outwardly, each of said tongs including a vertically elongated leg, a pivot member fixedly attached to and depending from said leg, said pivot member having an upper and a lower portion, a tong bit having an upper and a lower portion, said upper portion of said tong bit being pivotally attached to the outside of said upper portion of said pivot member by an upper link member, said lower portion of said tong bit being pivotally attached to the lower portion of said pivot member by a lower link member and extending under said pivot member and having an innermost end projecting inwardly of said pivot member, and means for resiliently restraining said tong bit against said pivot member. In a preferred embodiment the crane includes a bridge mounted for overhead travel and track means for supporting said bridge. Advantageously, the ropefalls are suspended by a pair of lifting barrels and a pair of upper sheaves that are rotatably mounted either on said bridge or on a trolley adapted for travel along said bridge, said lifting barrels being horizontally aligned in spaced parallel relationship to said upper sheaves.

DETAILED DESCRIPTION OF THE PREFERRED EMBODIMENT

Figure 1:
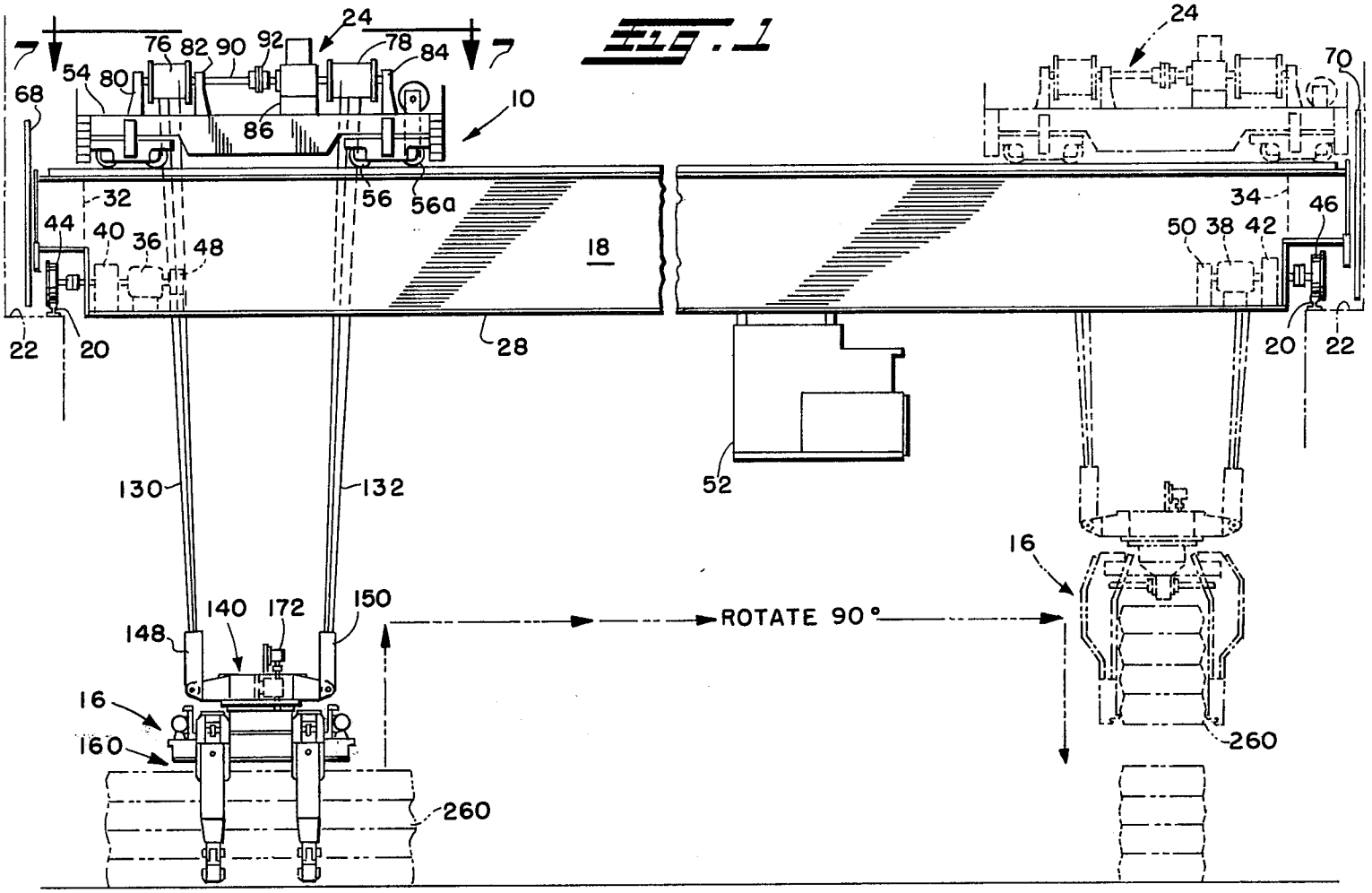
FIG. 1 is a fragmentary elevational view of a crane embodying the present invention in a particular form, with the trolley and grab assembly also being shown in phantom to illustrate the movement of such trolley and grab assembly.

The crane of the invention in its illustrated embodiment, as mounted, for example, for overhead travel, comprises (FIG. 1) an overhead travelling crane indicated generally by the reference numeral 10 which has provision for both longitudinal and transverse horizontal movements at right angles to one another, as indicated by directional arrows 12 and 14 (FIG. 7), so that the article being mounted can be lifted and deposited at any point within the rectangle covered by the movement of the crane; and a grab assembly indicated generally by the reference numeral 16 which is suspended by crane 10 and has provision for lifting massive articles such as aluminum or steel ingots and the like by grabbing such articles on their sides with positive engaging movements of opposed complemental tongs, all as hereinafter further explained.

Crane 10 comprises (FIG. 1) bridge 18 which spans, for example, the bay of a shop, foundry, smelter, mill or warehouse and is adapted for longitudinal horizontal movement along parallel tracks 20 which are mounted overhead on building structure 22; and a trolley indicated generally by the reference numeral 24 which is adopted for transverse horizontal movement along parallel tracks 26 which are mounted on bridge 18. It is to be understood, however, that any crane that is suitable for hoisting and moving articles such as aluminum or steel ingots can be used in combination with the grab assembly of the present invention. Such cranes include, for example, rotating bridge cranes pinned at one end on a vertical axis with the other end mounted for rotational movement about such axis on an arcuate or circular track, and polar cranes mounted for rotational movement on circular or arcuate tracks. A gantry crane which is similar in construction and design to overhead traveling crane 10 except that the overhead bridge is carried at each end by vertically elongated trestles which travel along tracks mounted on the ground can also be used in accordance with the present invention. In some instances an overhead crane supported at one end by an overhead rail mounted, for example, on the side of a building structure and supported at the other end by a vertically elongated trestle traveling on tracks mounted on the ground, can also be used in accordance with the present invention.

Figure 7:
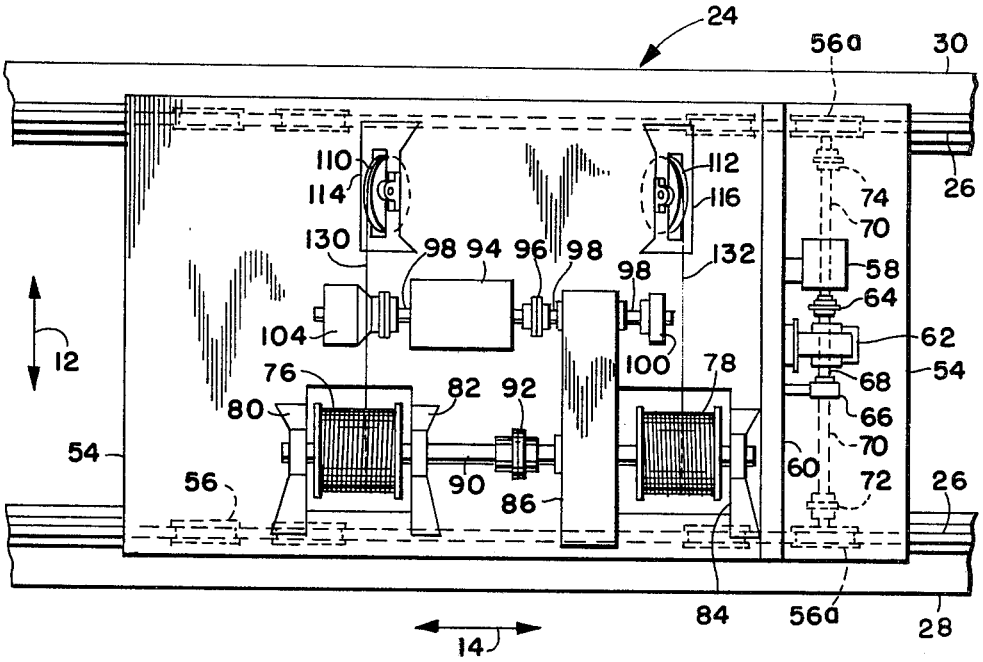
FIG. 7 is an enlarged top plan view of the crane of FIG. 1 taken along line 7—7 in FIG. 1.

Bridge 18 is a horizontally elongated rectangular frame comprising horizontally elongated parallel girders 28 and 30 connected by end-ties 32 and 34 (FIGS. 1 and 7). Girders 28 and 30 are sufficiently elongated to traverse the ground or floor area to be serviced by crane 10. End-ties 32 and 34 are shorter than girders 28 and 30 but are sufficiently elongated to provide structural stability to crane 10 and to provide an open area between girders 28 and 30 to allow for the movement and operation of trolley 24. Bridge 18 preferably has a walkway or platform (not shown) to provide for the servicing, repair and oiling of the bridge and trolley. The movement of bridge 18 along tracks 20 is accomplished by the operation of electric motors 36 and 38 which are mounted on girder 28. Motors 36 and 38 rotatably engage rear reducers 40 and 42, which drive wheels 44 and 46, respectively. Gear reducers 40 and 42 are also mounted on girder 28. Wheels 44 and 46 each consist of assemblies or sets of wheels depending from bridge 18 that are mounted for travel along tracks 20, the actual number of wheels being dependent upon the anticipated loads to be carried by crane 10. In a preferred embodiment two sets of two wheels are employed on each side of bridge 18, i.e., two sets of two wheels are employed at the location of wheel 44 and two sets are employed at the location of wheel 46. One wheel on each side of bridge 18 is driven by motors 36 and 38, respectively, the remaining wheels provide bridge 18 with support and follow the driven wheels. Electrically operated brakes 48 and 50 are mounted on girder 28 and aligned with motors 36 and 38, respectively, and are used to reduce or stop the rotation of such motors. Motors 36 and 38 are synchronized electrically with each other to insure a synchronized movement of wheels 44 and 46. The rotation of wheels 44 and 46 provides movement of bridge 18 in forward or reverse direction along tracks 20. The movements of bridge 18 as well as grab assembly 16 and trolley 24 are controlled from operator cage 52 which is fixedly attached to the bottom of girder 28 and comprises a central location for all the controls and switchboards necessary to activate and control each and every movement of the bridge, trolley and grab assembly.

Trolley 24 comprises a substantially rectangular frame 54 which is mounted on wheels 56 and adapted for transverse horizontal movement in the direction indicated by directional arrow 14 along parallel tracks 26. Trolley 24 is sufficiently horizontally elongated to span the opening between girders 28 and 30. Each of the girders 28 and 30 has one of the tracks 26 mounted on it. Trolley 24 is driven along tracks 26 by electric motor 58 which is mounted on frame member 60 of frame 54 and is rotatably attached to gear reducer 62 by coupling 64. Gear reducer 62 and electrically operated brake 66 are also mounted on frame member 60. Brake 66 engages line shaft 68 which projects from gear reducer 62. Motor 58, coupling 64, the upper portion of gear reducer 62, line shaft 68 and brake 66 are horizontally disposed on a centerline above frame 54. Gear reducer 62 projects vertically below frame 54. Drive shaft 70 is horizontally disposed on a center line below frame 54 and rotatably engages gear reducer 62. Mounted on the ends of drive shaft 70 are wheels **56*a*. Drive shaft 70 is rotatably attached to bearings 72 and 74 which are mounted in housings (not shown) that are welded to frame 54. Motor 58 and brake 66 are activated and controlled from operator cage 54. The rotation of the armature of motor 58 transmits rotational motion to gear reducer 62 which in turn causes drive shaft 70 to rotate and drive wheels 56*a*. The rotation of the armature in one direction drives trolley 24 from left to right along bridge 18 as illustrated in FIG. 1, the rotation of the armature in the opposite direction drives the trolley from right to left. The movement of trolley 24 is slowed or stopped by the activation of brake 66. The movement of trolley 24 beyond the edges of bridge 18 is prevented by bumper stops 68 and 70 which are welded to end-ties 32 and 34**, respectively.

Lifting barrel 76 is rotatably mounted on pillow blocks 80 and 82 which are welded to and project upwardly from frame 54. Pillow blocks 80 and 82 contain bearing assemblies that permit lifting barrel 76 to rotate about its center axis. Lifting barrel 78 is rotatably mounted at one end on pillow block 84 and is rotatably supported at the other end by gear reducer 86. Gear reducer 86 and pillow block 84 are welded to and project upwardly from frame 54. Pillow block 84 contains a bearing assembly that permits the rotation of lifting barrel 78 about its center axis. Lifting barrels 76 and 78 are disposed in spaced linear relationship with each other and are connected by drive shaft 90 which rotatably engages gear reducer 86. Coupling 92 is mounted on drive shaft 90 and disposed between pillow block 82 and gear reducer 86. Barrels 76 and 78 are rotated by electric motor 94, the center line of which is disposed in spaced parallel relationship to the center line of barrels 76 and 78. Motor 94 is mounted on frame 54 and is rotatably connected to gear reducer 86 by coupling 96. Line shaft 98 extends from coupling 96 to and through gear reducer 86 to engage electrically operated brake 100 which is mounted on frame 54. Line shaft 98 also extends in the opposite direction from gear reducer 86 to engage electrically operated brake 104 which is mounted on frame 54. The rotation of the armature of motor 94 in one direction causes barrels 76 and 78 to rotate and hoist grab assembly 16 upwardly while the rotation of the armature in the opposite direction causes the lowering of grab assembly 16. Line shaft 98 employs two brake assemblies to provide an added measure of safety. Thus, while one brake is adequate under very advantageous conditions, two are preferred. Upper sheaves 110 and 112 are rotatably mounted in housings 114 and 116 which are mounted on frame 54. The center axes of sheaves 110 and 112 are spaced a sufficient distance from the center axes of barrels 76 and 78 to provide for a stabilized reeving of ropefalls 130 and 132 and hoisting of grab assembly 16. Sheaves 110 and 112 are mounted in housing 114 and 116, respectively, with a slight tilt that projects inwardly and downwardly to accommodate the slight inward and downward projecting angles of ropefalls 130 and 132.

Depending from barrel 76 and upper sheave 110 are ropefalls 130. Likewise, depending from barrel 78 and upper sheave 112 are ropefalls 132. Ropefalls 130 and 132 are disposed between girders 28 and 30. Suspended by ropefalls 130 and 132 is grab assembly 16. The ropefalls, lifting barrels and upper sheaves are arranged so that the load hoisted and carried by trolley 24 is centrally distributed evenly over girders 28 and 30. Each ropefall 130 and 132 preferably comprises eight wire ropes, four of the ropes being coiled in righthanded grooves in each of the barrels 76 and 78, respectively, and the other four being coiled in lefthanded grooves in each of the respective barrels. Additional wire ropes, for example fourteen wire ropes with seven being coiled in lefthanded grooves and seven being coiled in righthanded grooves, or fewer wire ropes can be utilized with each ropefall, the number and design of such ropes being dependent upon the anticipated loads to be hoisted. In an alternate embodiment, the crane used to hoist and transport the grab assembly of the present invention is operated without a trolley. With such an embodiment the foregoing hoisting mechanism of lifting barrels, upper sheaves, ropefalls and associated drive assemblies are bolted or welded to the bridge of the crane. With this embodiment movement of the grab assembly is limited to up and down hoisting movements and horizontal movements corresponding to the movements of the bridge.

Lifting beam 140 (FIGS. 1–3), which is suspended by ropefalls 130 and 132, is a vertically oriented cylindrical frame 142 with horizontally elongated support members 144 and 146 welded to and projecting horizontally from the exterior surface of frame 142. Hoisting sheaves 148 and 150 are pivotally attached to and extend above members 144 and 146. Sheaves 148 and 150 are pivotally attached to members 144 and 146 by pins 152 and 154, respectively. A tong assembly, which is indicated generally by the reference numeral 160, is rotatably attached to and suspended under lifting beam 140 by rotate bearing assembly 162. Bearing assembly 162 is disposed between frame 142 and housing 170 and bolted to such frame and housing by peripheral bolts 164. Electric motor 172 is mounted on frame 142 and is adapted for rotating grab assembly 160 clockwise or counterclockwise relative to lifting beam 140. Motor 172 is rotatably attached to gear reducer 174 by coupling 176. Stub gear 178 depends from and is rotatably attached to gear reducer 174. Brake 180 is mounted on motor 172 and is adapted for reducing or stopping the rotation of stub gear 178 by reducing or stopping the rotation of the armature of motor 172. Motor 172 transmits rotational movement to stub gear 178 which engages internal teeth 182 of bearing assembly 162 to cause the clockwise or counterclockwise rotational movement of tong assembly 160. Such movement is slowed or stopped by the activation of brake 180. This operation is activated and controlled from operator cage 52. In an alternate embodiment, the grab assembly of the present invention is constructed without the foregoing rotate feature. In this alternate embodiment, frame 142 is welded or bolted to housing 170 and the foregoing drive and bearing assemblies are not employed.

Tong assembly 160 (FIGS. 2 and 3) comprises a pair of horizontally elongated parallel spaced frame members 190 and 192 connected by horizontally elongated frame member 194 which is disposed perpendicularly to members 190 and 192 and welded to the center portions of such members. Housing 170 is a vertically oriented cylindrical shell which is welded to and projects above frame member 194. Vertically extending horizontally movable opposed complemental tongs 200 and 202 depend from and extend beneath frame member 190, and vertically extending horizontally movable opposed complemental tongs 204 and 206 (206 not shown in the drawings) depend from frame member 192 in spaced parallel relationship to tongs 200 and 202 and extend beneath frame member 192. Tongs 200, 202, 204 and 206 are identical in design and construction and, accordingly, it is only necessary to describe the design and construction of tong 200, such description also being applicable to tongs 202, 204 and 206.

Figure 4:
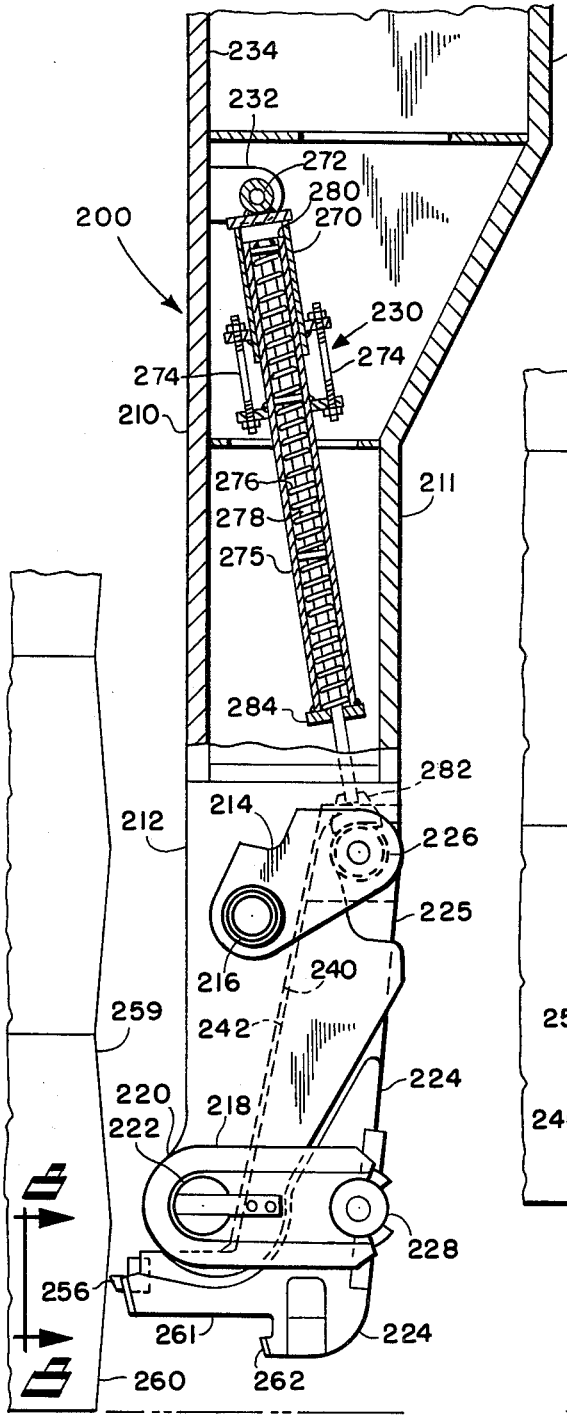
FIG. 4 is an enlarged fragmentary elevational view of the lower portion of a tong of FIG. 2.
Figure 5:
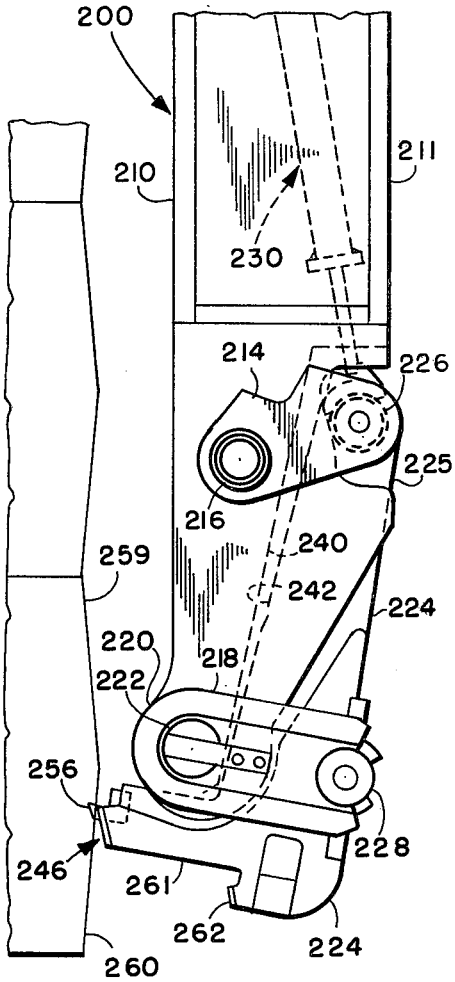
FIG. 5 is an enlarged fragmentary elevational view of the lower portion of a tong of FIG. 2 similar to the view illustrated in FIG. 4, but illustrating the penetrating engagement of the innermost end of the tong bit with the article being lifted.
Figure 8:
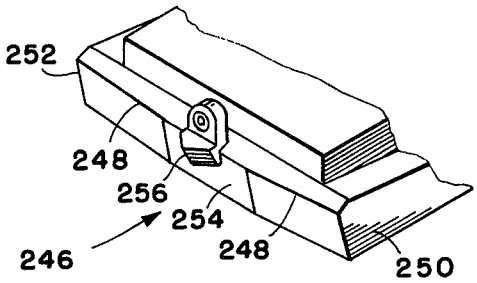
FIG. 8 is an enlarged fragmentary perspective view taken generally along line 8—8 of FIG. 4 illustrating a jaw used with the tong of the present invention.

Tong 200 comprises (FIGS. 4 and 5) vertically elongated leg 210, pivot member 212 welded to the bottom of and projecting below leg 210, upper link 214 which is pivotally attached to pivot member 212 by pin 216 and projects outwardly and upwardly from pin 216, lower link 218 which is pivotally attached to lower portion 220 of pivot member 212 by pin 222 and projects outwardly of lower portion 220, tong bit 224 which is pivotally attached to links 214 and 218 by pins 226 and 228, respectively, and is disposed outwardly of pivot member 212, and spring-plunger assembly 230 the top of which is pivotally attached to leg 210 at lug 232 which is welded to inner wall 234 of leg 210 and the bottom of which is pivotally attached to tong bit 224 by pin 226. Pivot member 212 has downwardly and inwardly sloping outer surface 240 that complements downwardly and inwardly sloping inner surface 242 of tong bit 224. The lower portion 211 of leg 210 is narrower than the upper portion 213 of leg 210. The narrowed lower portion provides added flexibility to the operation of the grab assembly of the present invention by permitting the assembly to be lowered into relatively narrow openings such as, for example, between relatively close stacks of aluminum or steel ingots. The relatively wide upper portion 213 provides tong 200 with strength and stability. Tong bit 224 has lower portion 261 that extends under pivot member 212 to a point inwardly of pivot member 212. Formed on the innermost end of tong bit 224 is jaw 246 which projects inwardly of pivot member 212. Jaw 246 has a rounded, bevelled edge 248 (FIG. 8) that projects inwardly at a slight angle from the outer surfaces 250 and 252 to a flat central portion 254. Edge 248 is sufficiently smooth or rounded to eliminate or minimize any indentations in the side of the article to be lifted. Mounted on jaw 247 is tong bit key 256 which is centrally located on central portion 254 and projects inwardly of central portion 254. Tong bit key 256 is formed from a material (e.g., hardened steel) that is hard enough to penetrate the side of the article to be lifted which is indicated by the reference numeral 260 (FIG. 5). Formed at the bottom of tong bit 224 is auxiliary jaw 262 which consists of an inwardly projecting rounded or smooth bevelled edge that is shaped similarly to jaw 246 with the exception that auxiliary jaw 262 does not have provision for a tong bit key; the edge of jaw 262 projects inwardly at a slight angle from its outer surfaces to a centrally located flat portion. Jaw 262 is useful in lifting articles that are stacked too closely to permit access by the tongs. Generally, only one article at a time such as, for example, one ingot, will be hoisted with jaw 262.

Spring-plunger assembly 230 resiliently restrains tong bit 224 upwardly against pivot 212, and comprises upper housing 270 which is pivotally attached to lug 232 by pin 272, lower housing 275 which is secured to housing 270 by bolts 274, spring 276 which is confined by housings 270 and 275, and plunger 278. The upper portion 280 of plunger 278 is welded to the upper end of plunger 278 and restrained by spring 276. The lower portion of plunger 278 is welded to plunger-pin connector 282 which is pivotally attached to tong bit 224 and upper link 214 by pin 226. Plunger 278 slidably projects through the lower end 284 of housing 275.

The uppermost portion of leg 210 (FIGS. 2 and 3) has an opening 291 for accommodating frame member 190; opening 291 is adapted for permitting frame member 190 to extend through opening 291 when tong 200 is moved inwardly. Tongs 200 and 202, and 204 and 206 are moved inwardly and outwardly by the operation of screw drive assemblies 292 and 294, respectively. The inward and outward movement of tongs 200 and 292, and 204 and 206, and the operation of screw drive assemblies 292 and 294 are identical in design and operation, and, accordingly the following detailed description with respect to tongs 200 and 202 and assembly 292 is applicable to tongs 204 and 206 and assembly 294 and no further discussion of the design and operation of the latter is required. Tongs 200 and 202 are pivotally attached to and slide on rollers 300 and 302, and 304 and 306, respectively, which roll in horizontally elongated parallel spaced channels 308 and 310 which are formed in both sides of frame member 190. Tongs 200 and 202 are vertically aligned by lift rollers 312 and 314 which rotate on the top of frame member 190 and are adjusted by adjustment bolts 316 and 318, respectively.

Figure 6:
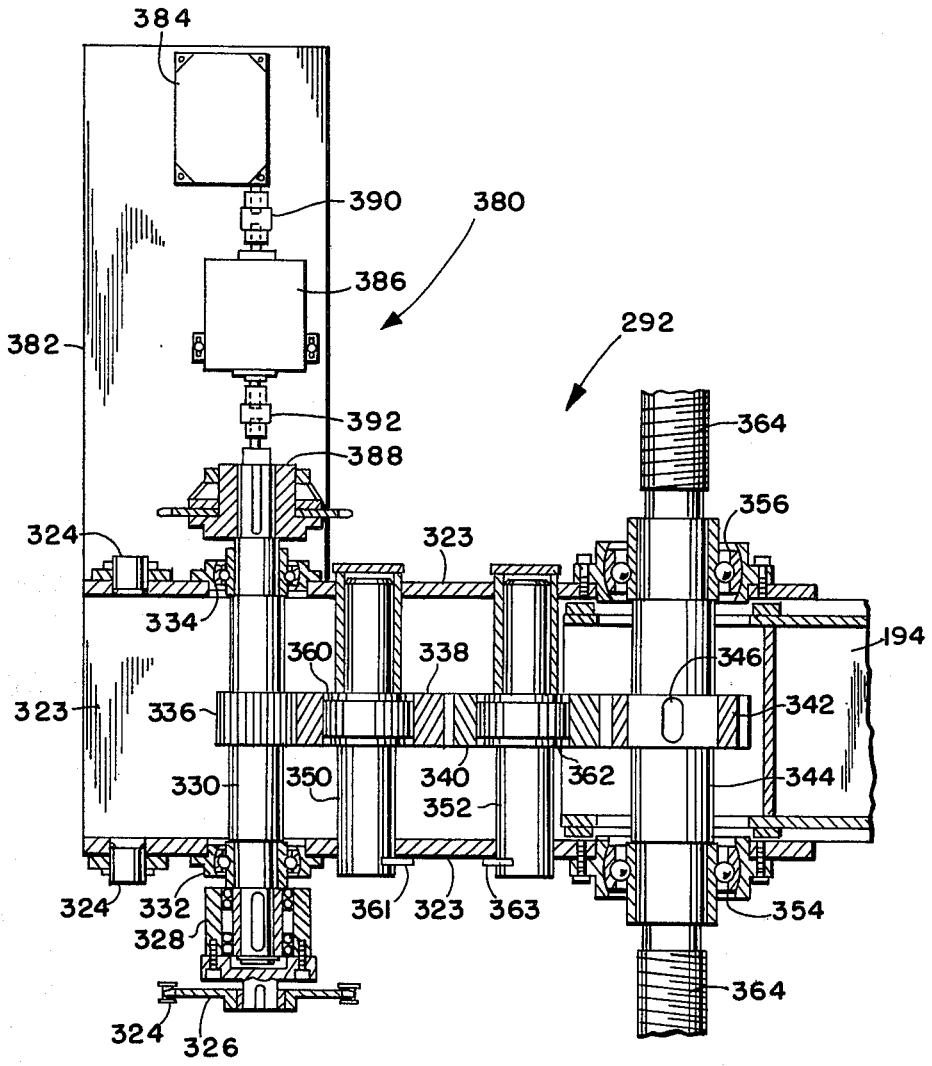
FIG. 6 is a sectional view taken along line 6—6 of FIG. 3 illustrating part of the screw drive assembly for opening and closing the tongs.

Screw drive assembly 292 is driven by motor 320 (FIG. 3) which is mounted on bracket 322. Bracket 322 is welded to frame member 194. Depending from frame member 194 is gear box 323 which is suspended at one end by links 324 (FIGS. 3 and 6) and at the other end by screw 364. Motor 320 turns chain drive 325 which engages and rotates sprocket 326. Sprocket 326 is rotatably attached to cam clutch 328 (FIG. 6). Drive shaft 330 is rotatably attached to cam clutch 328 and is supported by bearings 332 and 334 which are mounted on gear box 323. Drive shaft 330 is attached to gear 336.

Gears 336, 338, 340 and 342 are arranged in a spaced linear engaging relationship. The rotation of gear 336 causes the rotation of gear 338 which in turn causes the rotation of gear 340 which causes the rotation of gear 342. The rotation of gear 342 is in clockwise direction when gear 336 is rotated counter-clockwise, and vice-versa. The rotation of gear 342 causes the rotation of drive shaft 344 which engages gear 342 at key way 346. Gear 338 is mounted on shaft 350 and gear 340 is mounted on shaft 352. Drive shaft 344 is rotatably supported by bearings 354 and 356 which are mounted on frame member 194. Bearings 360 and 362 are disposed between gear 338 and shaft 350, and gear 340 and shaft 352, and permit the rotational movement of gears 338 and 340 with respect to shafts 350 and 352, respectively. Shafts 350 and 352 are mounted on gear box 323 and restrained from rotational movement by key plates 361 and 363, respectively. The rotational movement of drive shaft 344 causes the rotation of threaded screw 364 which turns in threaded bores 366 and 368 (FIG. 2) of tongs 200 and 202 and causes the inward and outward movements of tongs 200 and 202.

Figure 2:
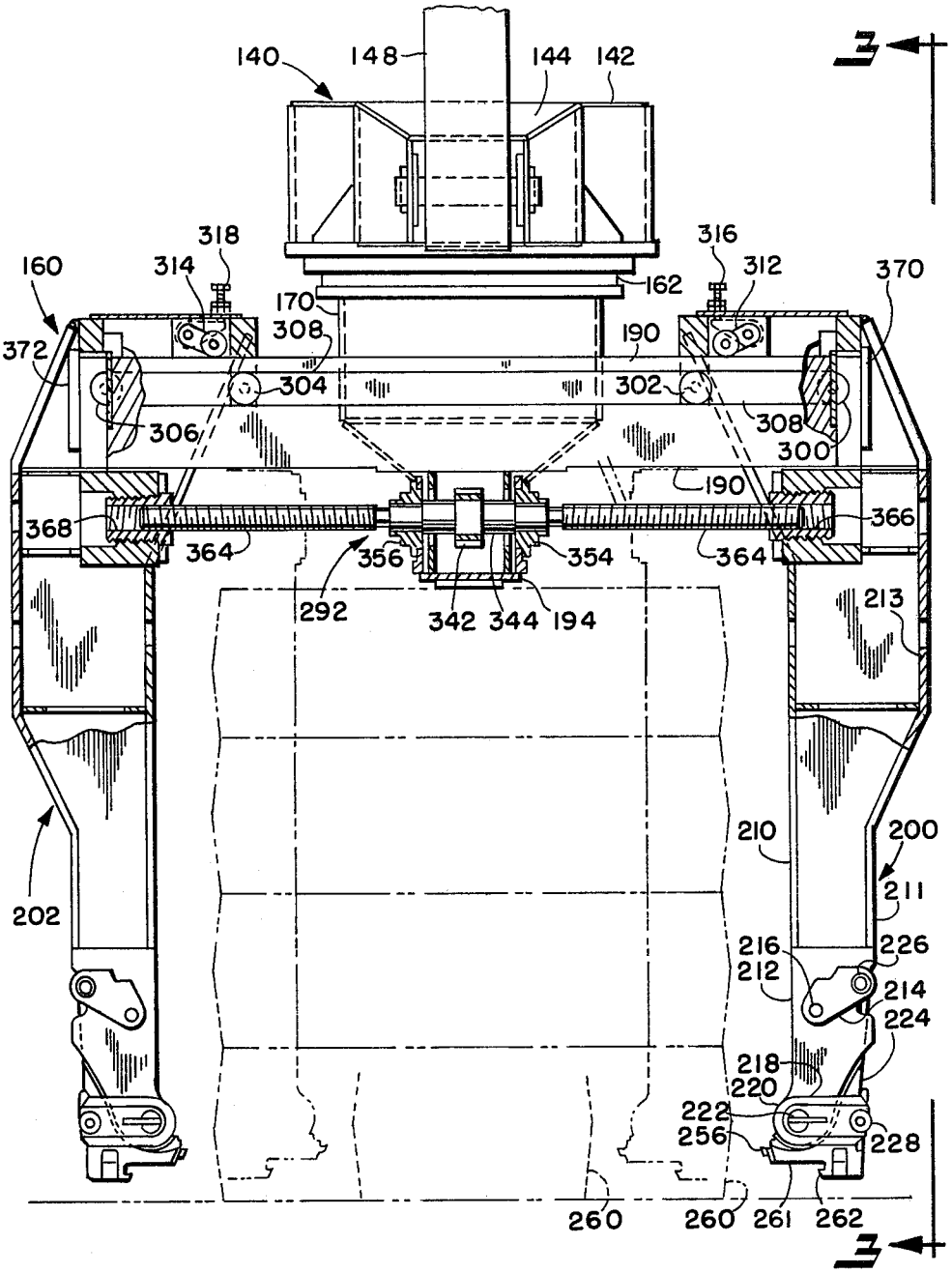
FIG. 2 is an enlarged, partially sectioned, elevational view of the grab assembly of the crane of FIG. 1, with the tongs also being shown in phantom to illustrate the inward movement of such tongs.
Figure 3:
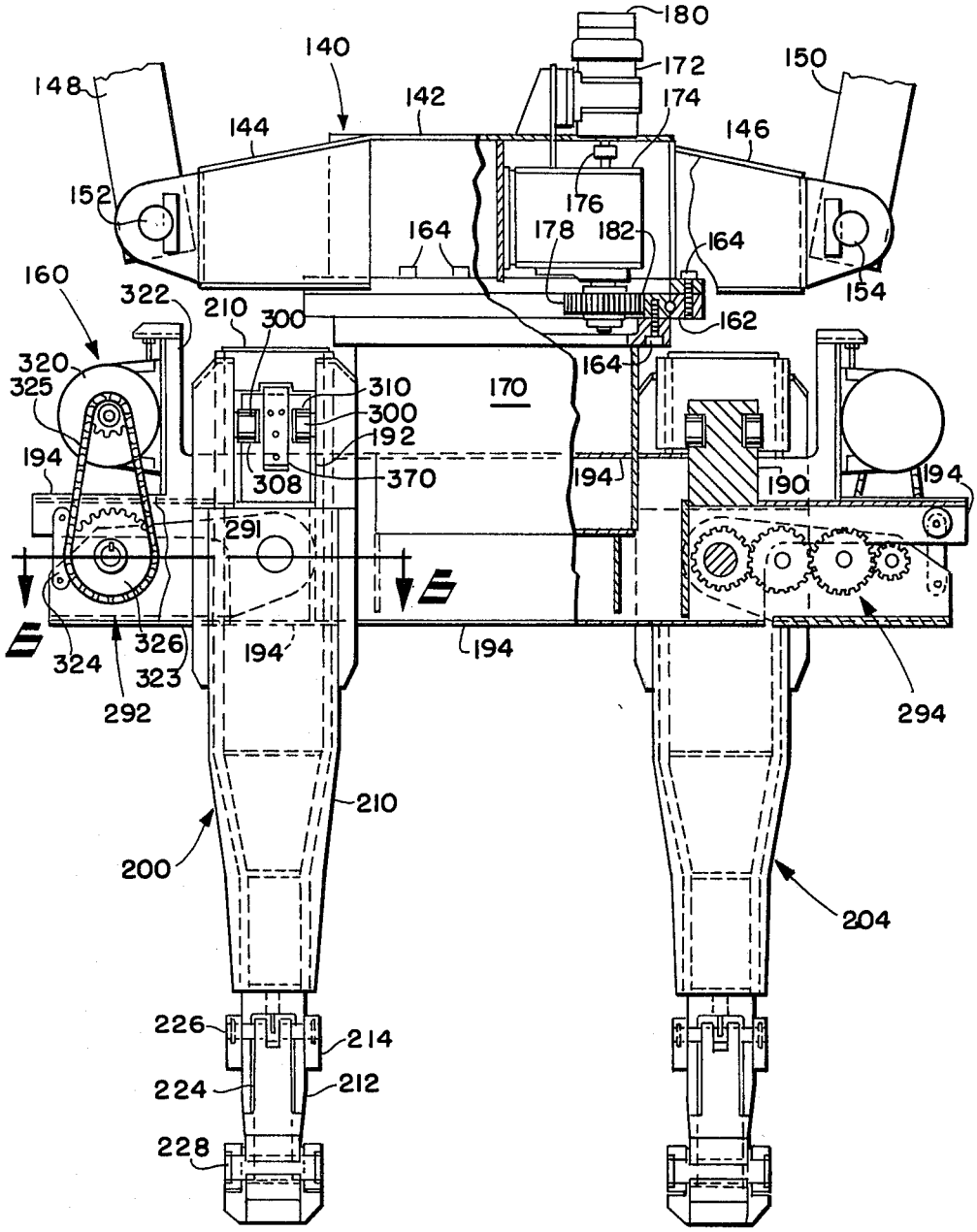
FIG. 3 is a fragmentary elevational view of the grab assembly of FIG. 2 taken along line 3—3 in FIG. 2.

The outward movement of tongs 200 and 202 is ultimately limited by end stops 370 and 372 which are bolted to frame member 190 (FIG. 2). End stops 370 and 372 are utilized in the event limit switch assembly 380 (discussed below) fails. The inward and outward movement of tongs 200 and 202 is limited by limit switch assembly 380 (FIG. 6) which is mounted on elongated plate 382 which is welded to and projects horizontally from frame member 194. Assembly 380 comprises limit switch 384, speed response switch 386 and torque limiter 388. Limit switch 384 is connected to response switch 386 by coupling 390 and response switch 386 is connected to torque limiter 388 by coupling 392. Limit switch 384 limits the inward and outward movement of tongs 200 and 202 by shutting off motor 320 when tongs 200 and 202 reach a predetermined point of inward or outward movement. Torque limiter 388 limits the torque produced by motor 320. When the torque of the motor reaches a predetermined level the torque limiter 388 slips causing the rotation of the armature of motor 320 to stop. Speed response switch 386 shuts off motor 320 when the rotation of motor 320 stops.

In operation (FIG. 1), bridge 18 is moved along tracks 20 and trolley 24 is moved along tracks 26 until grab assembly 16 is suspended over the article to be lifted which is indicated by the reference numeral 260. Grab assembly 16 is then lowered with tongs 200, 202, 204 and 206 being sufficiently open to permit assembly 16 to fit over article 260. Tongs 200, 202, 204 and 206 are then moved inwardly (FIG. 2) against article 260 and closed to a predetermined closing force which is limited by torque limiter 388 with tong bit key 256 in contact with article 260 (FIG. 4). Motor 94 (FIGS. 1 and 7) is then activated to rotate lifting barrels 76 and 78 to effect the upwardly hoisting movement of grab assembly 16. Ropes 130 from barrel 76 wrap over upper sheave 110 and then drop to sheave 148, wrap around sheave 148 and return to trolley 24 where the ropes dead ends are connected to frame 54. Similarly, ropes 132 from barrel 78 wrap over upper sheave 112 and then drop to sheave 150, wrap around sheave 150 and return to trolley 24 where the ropes dead ends are connected to frame 54. Lifting barrels 76 and 78 have right handed and left handed grooves which permits the ropes to either unwind or wind on the barrels resulting in a consequent shortening or lengthening of ropefalls 130 and 132 to lift or lower grab assembly 16. Upper sheaves 110 and 112 provide for stabilized reeving.

In the following discussion relating to the operation of the tong and grab assembly of the present invention reference will in some instances be made only to specific features of tong 200 or to the relative movements of tongs 200 and 202. It is to be understood, however, that since tongs 200 and 202, and 204 and 206 are identical in design and construction, that the discussion relating to the operation of tong 200 or 202 also covers the operation of tongs 204 and 206. The contacting engagement of tong bit key 256 against article 260 (FIGS. 4 and 5) in combination with the upwardly hoisting movement of grab assembly 16 causes the lower portion 261 of tong bit 224 to be cammed by lower link 218 downwardly and inwardly and the upper portion 225 of tong bit 224 to be cammed by upper link 214 downwardly and outwardly with plunger 278 compressing spring 276 and moving downwardly with tong bit 224. The downward and outward movement of upper portion 225 in combination with the downward and inward movement of lower portion 261 causes an inward and downward movement of jaw 246 which in turn urges tong bit key 256 into penetrating engagement with article 260 (FIG. 5). The penetrating engagement of tong bit key 256 with article 260 permits the grab assembly to be moved upwardly without jaw 246 slipping or sliding off the side of article 260. In this regard tong bit key 256 facilitates the grabbing of the side of article 260 even in instances wherein the side is not flat and is difficult to grip such as, for example, the upwardly and inwardly sloping side 259 of article 260. As article 260 is lifted the grip of jaw 246 against the sides of article 260 increases with the result being a positive gripping action on the side of article 260 that is sufficient to safely and effectively hoist article 260. The positive gripping action of jaw 246 against the side of article 260 is sufficient to provide for the lifting of massive articles. When the grab assembly of the present invention is used for lifting aluminum or steel ingots, a plurality of ingots, for example, four ingots weighing in excess of fifty tons as illustrated in FIG. 1, can be lifted at one time. The relatively smooth bevelled edge 248 of jaw 246 does not penetrate, or only slightly penetrates, the side of article 260. The penetration by tong bit key 256 is minimized by its size.

As the article 260 is hoisted and moved (FIG. 1) to its destination it can be rotated clockwise or counter-clockwise to accommodate stacking or storage requirements by the activation of motor 172 and the resulting rotation of tong assembly 160. The gripping action of jaw 246 with article 260 is automatically released when the article 260 is stacked or placed down and the tongs 200 and 202 are moved outwardly. The automatic release results fom the discontinuation of the upwardly hoisting force applied to the side of article 260 and the simultaneous release of spring 276 which causes plunger 278 to move upwardly resulting in the return of tong bit 224 from the position illustrated in FIG. 5 to the position illustrated in FIG. 4. When tongs 200 and 202 are moved outwardly to disengage tong bit key 256 more torque is required of motor 320 than is required to engage tong bit key 256 with the side of article 260. Such outward movement of tongs 200 and 202 causes torque limiter 388 to slip. However, cam clutch 328 grabs and permits motor 320 to operate and thereby effect the outward movement of tongs 200 and 202. In effect, cam clutch 328 is not utilized during the inward movements of tongs 200 and 202, and torque limiter 388 is not used during the outward movement of such tongs. Jaw 262 can be used to lift small loads such as, for example, a single ingot. Jaw 262 is particularly useful when such ingots are stacked too closely to permit access by the tongs.

An advantage of the mechanism used herein is that articles such as aluminum or steel ingots can be grabbed from their side, and safely and effectively lifted, without the necessity of employing non-positive acting side clamping mechanisms that require substantially greater levels of inward clamping force than those required with the mechanism of the present invention. For example, loads of four ingots weighing fifty-five tons can be hoisted with the grab assembly of the invention using a 7.5 to 10 horsepower motor for motor 320. On the other hand, if the positive grip lifting tongs of the present invention were not used and in their place conventional non-positive gripping tongs were used it is estimated the size of this motor would have to be increased to about 25 to 30 horsepower.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A tong for use in lifting articles such as aluminum or steel ingots and the like comprising an elongated leg, a pivot member fixedly attached to and depending from said leg, said pivot member having an upper portion and a lower portion, an upper link, first upper pin means for pivotally attaching said upper link to said upper portion of said pivot member, a lower link, first lower pin means for pivotally attaching said lower link to said lower portion of said pivot member, a tong bit having an upper portion disposed outwardly of said pivot member and a lower portion, second upper pin means for pivotally attaching said upper link to said upper portion of said tong bit, second lower pin means for pivotally attaching said lower link to said lower portion of said tong bit, said second upper pin means being positioned outwardly of said first upper pin means, said second lower pin means being positioned outwardly of said first lower pin means, said lower portion of said tong bit extending under said pivot member and having an innermost end projecting inwardly of said pivot member, said innermost end including means for penetratingly engaging a side of the article to be lifted, and means for resiliently restraining said tong bit against said pivot member.

2. The tong of claim 1 wherein said means comprises a spring and plunger assembly, said assembly having an upper end pivotally attached to said leg member and a lower end pivotally attached to the upper portion of said tong bit.

3. The tong of claim 1 wherein said innermost end comprises a jaw for engaging the side of the article to be lifted.

4. The tong of claim 1 wherein said means for penetratingly engaging the side of the article to be lifted comprises a tong bit key.

5. The tong of claim 1 with an auxiliary jaw depending from the bottom of said lower portion of said tong bit, said auxiliary jaw being disposed downwardly and outwardly of said innermost end.

6. The tong of claim 5 wherein said jaw and said auxiliary jaw each comprise a bevelled edge that is sufficiently rounded to eliminate or minimize indentations in the sides of the articles to be lifted by said tong.

7. A grab assembly for lifting articles such as aluminum or steel ingots and the like comprising a support frame, a first pair of vertically projecting horizontally movable opposed complemental tongs depending from and extending beneath said frame, means for moving said first pair of tongs horizontally inward and outward, a second pair of vertically projecting horizontally movable opposed complemental tongs depending from and extending beneath said frame, said second pair of tongs being disposed in spaced parallel relationship to said first pair of tongs, means for moving said second pair of tongs horizontally inward and outward, each of said tongs including a vertically elongated leg, a pivot member fixedly attached to and depending from said leg, said pivot member having an upper and a lower portion, a tong bit having an upper and a lower portion, said upper portion of said tong bit being attached to said upper portion of said pivot member by an upper link member, said upper link member being pivotally attached to said upper portion of said pivot member by first upper pin means, said upper link member being pivotally attached to said upper portion of said tong bit by second upper pin means, said second upper pin means being positioned outwardly of said first upper pin means, said lower portion of said tong bit being attached to the lower portion of said pivot member by a lower link member, said lower link member being pivotally attached to said lower portion of said pivot member by first lower pin means, said lower link member being pivotally attached to said lower portion of said tong bit by second lower pin means, said second lower pin means being positioned outwardly of said first lower pin means, said lower portion of said tong bit extending under said pivot member and having an innermost end projecting inwardly of said pivot member, said innermost end including means for penetratingly engaging a side of the article to be lifted, and means for resiliently restraining said tong bit against said pivot member.

8. The grab assembly of claim 7 with a centrally disposed housing fixedly attached to and projecting above said frame and a lifting beam mounted on said housing.

9. The grab assembly of claim 8 with means for rotating said frame relative to said lifting beam.

10. The grab assembly of claim 9 wherein said rotating means comprises a rotate bearing disposed between said housing and said lifting beam and an electric motor mounted on said beam.

11. The grab assembly of claim 8 wherein said lifting beam comprises a vertically oriented cylindrical frame with a pair of horizontally elongated support members fixedly attached to the side of and projecting horizontally from said cylindrical frame and a pair of hoisting sheaves pivotally attached to and extending above said support members.

12. The grab assembly of claim 7 with means for limiting the inward movement of said first pair and said second pair of tongs.

13. The grab assembly of claim 7 with means for limiting the outward movement of said first pair and said second pair of tongs.

14. The grab assembly of claims 12 or 13 wherein said inward movement limiting means and said outward movement limiting means comprises a limit switch assembly.

15. The grab assembly of claim 13 wherein said outward movement limiting means comprises end stops fixedly attached to said frame.

16. The grab assembly of claim 7 wherein said first pair of tongs and said second pair of tongs slide inwardly and outwardly on rollers disposed in channels formed in said frame.

17. The grab assembly of claim 7 wherein said support frame comprises a pair of horizontally elongated parallel spaced frame members connected by a horizontally elongated frame member disposed perpendicularly to said parallel spaced frame members.

18. A crane for transporting articles such as aluminum or steel ingots and the like comprising a bridge, a plurality of ropefalls depending from said bridge, a support frame suspended by said ropefalls, a first pair of vertically elongated horizontally movable opposed complemental tongs depending from and projecting below said support frame, means for moving said first pair of tongs inwardly and outwardly, a second pair of vertically elongated horizontally movable opposed complemental tongs depending from and projecting below said support frame, said second pair of tongs being disposed in spaced parallel relationship to said first pair of tongs, means for moving said second pair of tongs inwardly and outwardly, each of said tongs including a vertically elongated leg, a pivot member fixedly attached to and depending from said leg, said pivot member having an upper and a lower portion, a tong bit having an upper and a lower portion, said upper portion of said tong bit being attached to said upper portion of said pivot member by an upper link member, said upper link member being pivotally attached to said upper portion of said pivot member by first upper pin means, said upper link member being pivotally attached to said upper portion of said tong bit by second upper pin means, said second upper pin means being positioned outwardly of said first upper pin means, said lower portion of said tong bit being attached to the lower portion of said pivot member by a lower link member, said lower link member being pivotally attached to said lower portion of said pivot member by first lower pin means, said lower link member being pivotally attached to said lower portion of said tong bit by second lower pin means, said second lower pin means being positioned outwardly of said first lower pin means, said lower portion of said tong bit extending under said pivot member and having an innermost end projecting inwardly of said pivot member, said innermost end including means for penetratingly engaging a side of the article to be lifted, and means for resiliently restraining said tong bit against said pivot member.

19. The crane of claim 18 wherein said bridge is mounted for overhead travel and track means for supporting said bridge.

20. The crane of claims 18 or 19 with a pair of lifting barrels and a pair of upper sheaves rotatably mounted on said bridge, said lifting barrels being horizontally aligned in spaced parallel relationship to said upper sheaves, and means for rotating said lifting barrels.

21. The crane of claim 20 wherein said ropefalls depend from said lifting barrels and said take-up sheaves.

22. The crane of claims 18 or 19 with a trolley mounted on said bridge, said trolley being adapted for horizontal travel along said bridge.

23. The crane of claim 22 wherein said trolley comprises a rectangular frame, wheel means for supporting said frame, said wheel means being adapted for travel along parallel spaced tracks mounted on said bridge, means for driving said wheel means, and means mounted on said frame for hoisting said support frame.

24. The crane of claim 23 wherein said hoisting means comprises a pair of lifting barrels and a pair of upper sheaves rotatably mounted on said rectangular frame, said lifting barrels being horizontally aligned in spaced parallel relationship to said upper sheaves, and means for rotating said lifting barrels.

25. The crane of claim 24 wherein said ropefalls depend from said lifting barrels and said take-up sheaves.

26. The crane of claim 19 wherein said track means comprises a pair of overhead parallel tracks.

27. The crane of claim 19 wherein said track means is mounted overhead.

28. The crane of claim 27 wherein said track means comprises a pair of parallel spaced horizontally elongated tracks.

29. The crane of claim 18 with an operator cage depending from said bridge.

30. The crane of claim 18 wherein said bridge is a horizontally elongated rectangular frame comprising a pair of horizontally elongated girders connected by end-ties, said girders being sufficiently elongated to traverse the ground or floor area being serviced by said crane, said end-ties being sufficiently elongated to provide said crane with structural stability.

* * * * *